US006145528A

United States Patent [19]

Egnew et al.

[11] Patent Number: 6,145,528

[45] Date of Patent: Nov. 14, 2000

[54] PORTABLE BLIND

[75] Inventors: James C. Egnew, Stearns, Ky.; Elvin Byrd, Jr., Oneida, Tenn.

[73] Assignee: Shelter-Pro, LLC, Whitley City, Ky.

[21] Appl. No.: 09/105,689

[22] Filed: Jun. 26, 1998

[51] Int. Cl.[7] ..... E04H 15/60

[52] U.S. Cl. ..... 135/128; 135/114; 135/143; 135/151; 135/901; 43/1; 43/2; 160/135; 160/351; 160/377; 160/384; 403/217

[58] Field of Search ..... 135/96, 97, 126, 135/128, 132, 143, 117, 114, 115, 118, 151, 901, 902, 154; 160/351, 135, 377, 382, 384; 43/1, 2; 403/217, 219

[56] References Cited

U.S. PATENT DOCUMENTS

| | | | |
|---|---|---|---|
| 2,335,274 | 11/1943 | Hampton . | |
| 2,420,898 | 5/1947 | Miner . | |
| 2,882,913 | 4/1959 | Beauregard . | |
| 3,642,318 | 2/1972 | Avant . | |
| 3,709,237 | 1/1973 | Smith | 135/1 R |
| 3,913,598 | 10/1975 | Glutting, Jr. et al. . | |
| 4,332,266 | 6/1982 | Wageley . | |
| 4,685,484 | 8/1987 | Moneta | 135/117 |
| 4,773,437 | 9/1988 | Glutting . | |
| 4,777,755 | 10/1988 | Colburn . | |
| 5,054,507 | 10/1991 | Sparks | 135/97 |
| 5,062,234 | 11/1991 | Green . | |
| 5,377,711 | 1/1995 | Mueller . | |
| 5,379,786 | 1/1995 | Lynam | 135/87 |
| 5,414,950 | 5/1995 | Johnson, Sr. | 43/1 |
| 5,609,176 | 3/1997 | Weeks . | |

FOREIGN PATENT DOCUMENTS

| | | |
|---|---|---|
| 1392939 | 5/1975 | United Kingdom . |

*Primary Examiner*—Carl D. Friedman
*Assistant Examiner*—Yvonne M. Horton
*Attorney, Agent, or Firm*—Ludeka Neely & Graham P.C.

[57] ABSTRACT

A blind having a support system and a sheet material secured to at least a portion of the support system. The support system includes a number (n) of horizontal support members and a number (n+1) of vertical support members, wherein n corresponds to an integer of 2 or greater, and a plurality of flexible joints connecting each vertical support member to at least one of the horizontal support members, with at least one of the vertical support members connected by one of the joints to at least two of the horizontal support members.

12 Claims, 9 Drawing Sheets

PORTABLE BLIND

FIELD OF THE INVENTION

This invention relates generally to portable blinds and concealment structures. More particularly, this invention relates to a portable blind that is lightweight, compact and quickly erected.

BACKGROUND AND SUMMARY OF THE INVENTION

Portable hunting blinds, such as the so-called "stick blinds", typically utilize vertical poles to support a sheet material. These blinds are desirable because of their low cost, however, they have several disadvantages. For example, stick blinds require guy ropes and stakes for assembly of the blind. The ropes and stakes take away from the simplicity of the blind and complicate its use and transportation.

Accordingly, an object of the present invention is to provide a portable blind.

It is a further object of the invention to provide a portable blind that is lightweight, compact and quickly erected and which avoids the need for guy ropes and associated stakes for tensioning the guy ropes.

Another object of the invention is to provide a blind of the character described that is stable and easily assembled, disassembled and transported.

Still another object of the invention is to provide a blind of the character described that can be erected in a variety of orientations.

An additional object of the invention is to provide a device of the character described which is inexpensive to produce and convenient to use.

With regard to the foregoing and other objects, the present invention is directed to a portable blind.

In a preferred embodiment, the blind includes a support system and a sheet material secured to at least a portion of the support system. The support system includes a number (n) of horizontal support members and a number (n+1) of vertical support members, wherein n corresponds to an integer of 2 or greater. A plurality of flexible joints connect each vertical support member to at least one of the horizontal support members, with at least one of the vertical support members connected by one of the joints to at least two of the horizontal support members.

In a preferred embodiment, the support system includes a pair of horizontal support members, preferably in the form of wooden dowels, and three vertical support members made of aluminum tubing and having spikes provided at their lower ends for impaling the ground. The outer vertical supports are preferably connected to the outer ends of their adjacent horizontal supports by short lengths of polymer tubing which slide over the ends of the supports to provide a flexible joint. The interior adjacent ends of the horizontal supports are likewise joined together by a length of polymer tubing and the middle vertical support is connected to this joint by a length of polymer tubing which has one end slipped over the middle vertical support and the other end attached by threads to the polymer tubing connecting the horizontal supports. This provides a central joint connecting the middle vertical support to the horizontal supports.

In another aspect, the invention provides a support system for a blind, the support system including a number (n) of horizontal support members and a number (n+1) of vertical support members, wherein n corresponds to an integer of 2 or greater. A plurality of flexible joints connect each vertical support member to at least one of the horizontal support members, with at least one of the vertical support members connected by one of the joints to at least two of the horizontal support members.

In yet another aspect, the invention relates to a collapsible and portable blind system, including a collapsible support system, a sheet material secured to at least a portion of the support system and means for securing the support system and the sheet material in an elongate, rolled configuration for ease of transportation and storage. The support system includes a plurality of horizontal support members, a plurality of vertical support members, and a plurality of flexible joints. Each flexible joint is configured to enable at least one vertical support member to be selectively connectable to at least one horizontal support member. The joints and the horizontal and vertical support members cooperate to enable the the support system and the sheet material to be configured in the elongate, rolled configuration.

A significant advantage of the invention relates to the ease of which the blind may be set-up and taken down. Also, the blind is lightweight and is adaptable to a variety of terrain conditions and set-up orientations. The blind also offers a rigid set-up which avoids the need for guy ropes and stakes and the horizontal members provide a gun or camera rest.

BRIEF DESCRIPTION OF THE DRAWINGS

The above and other features and advantages of the present invention will become further known from the following detailed description considered in conjunction with the accompanying drawings in which.

DETAILED DESCRIPTION

Figure 1:
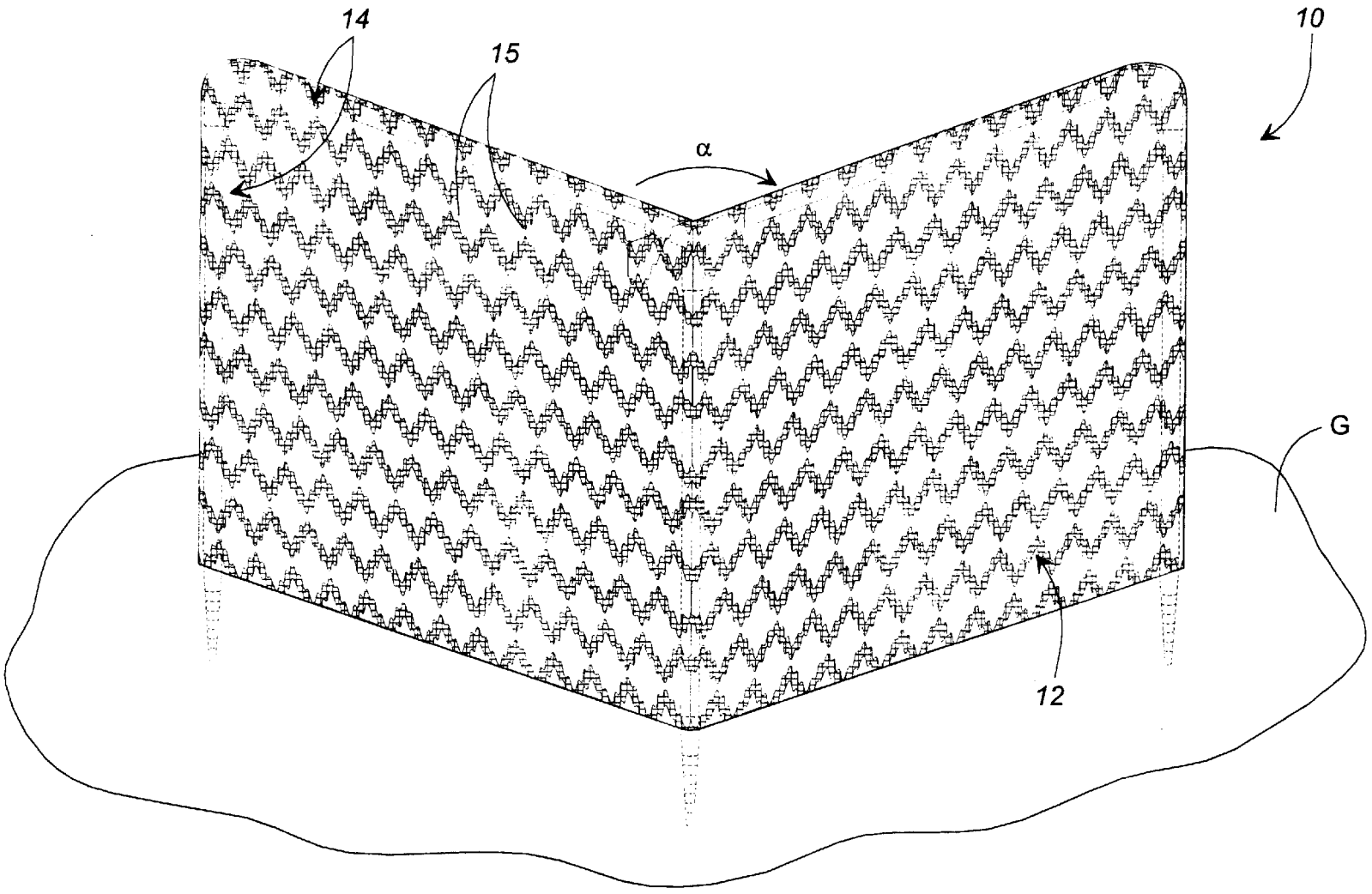
FIG. 1 is a front perspective view of a blind in accordance with a preferred embodiment of the invention.

With initial reference to FIG. 1, there is shown a perspective view of a blind 10 in accordance with a preferred embodiment of the invention. The blind 10 includes sheet material 12 supported by a support system 14. The support system 14 supports the sheet material 12 in a relatively stretched state when the blind is erected, with the general plane of the sheet material 12 being generally perpendicular to the ground G so as to provide a structure that a user can either hide behind or that can be positioned behind the user to break up the outline of the body of the user.

For example, a hunter may prefer to erect the blind 10 in front of a tree, with the hunter sitting with his back against the tree such that he is between the blind and the tree. This set-up enables the blind 10 to be used as a structure to hide behind to conceal his outline and motion. In the alternative, the hunter may prefer to set the blind up behind the tree and sit with his back against the opposite side of the tree such that the tree is between the hunter and the blind, with the blind extending outwardly from the tree. In this set-up, the blind will serve as a background and obfuscate the outline of the hunter. Other set-ups may be achieved without the use of structures such as trees or with other structures such as rocks, bushes and the like. That is, the versatility of the blind 10 enables it to be used in open fields or in structured environments having trees, boulders and the like to conceal motion and the outline of the hunter.

The sheet material 12 is preferably a fabric printed in camouflage colors and patterns such as leaves, limbs and other foliage. A preferred fabric is a non-woven poly bonded rot and mildew resistant fabric available from Avery Outdoors of Memphis, Tenn. under the trade name CEREX. This product has cuts 15 which provide a three-dimensional effect to the fabric and this product is marketed in several camouflage colors and patterns, one of which is available under the tradename MOSSY OAK BREAKUP.

Figure 2:
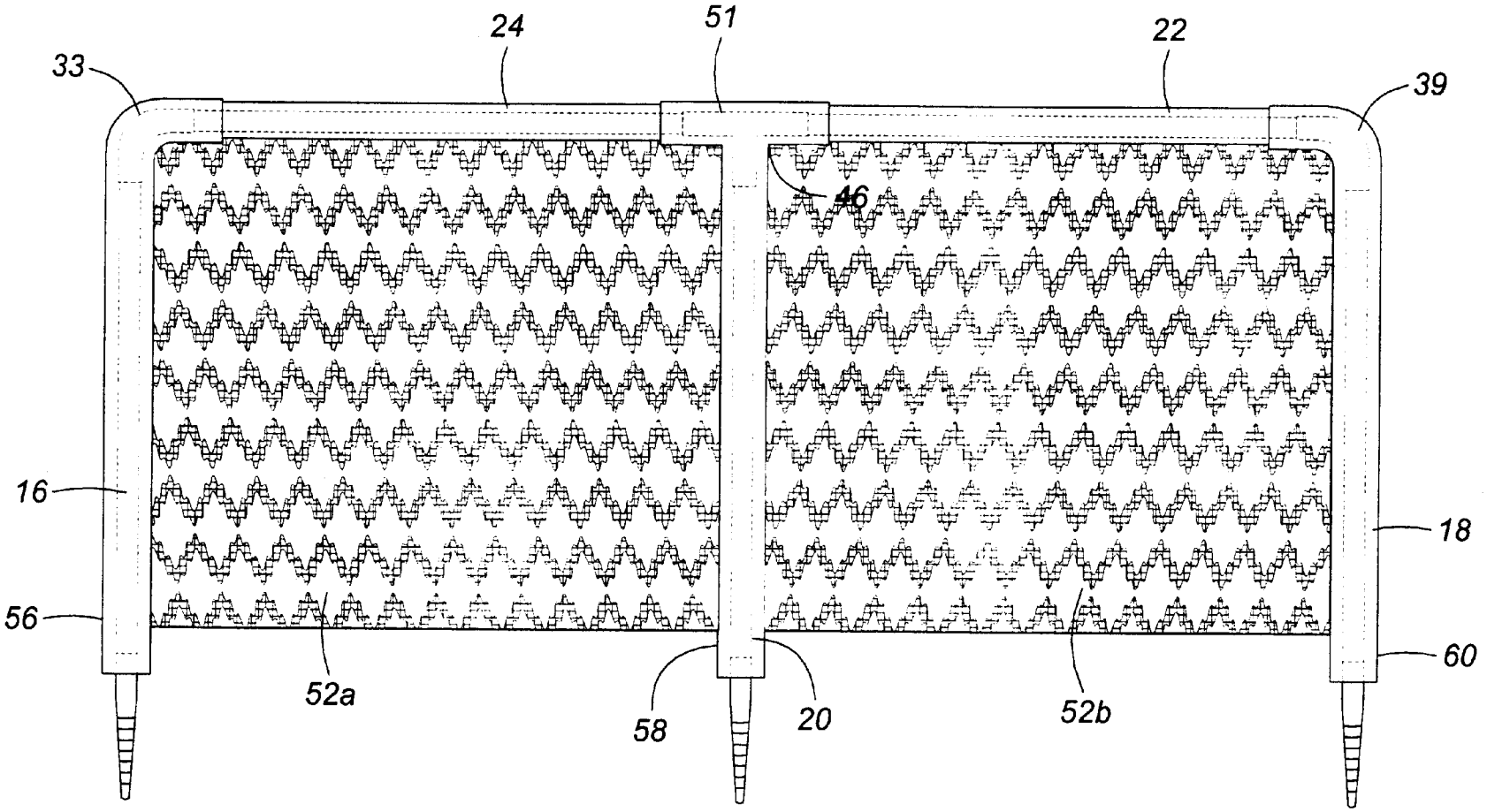
FIG. 2 is a rear plan view of the blind of FIG. 1.
Figure 3:
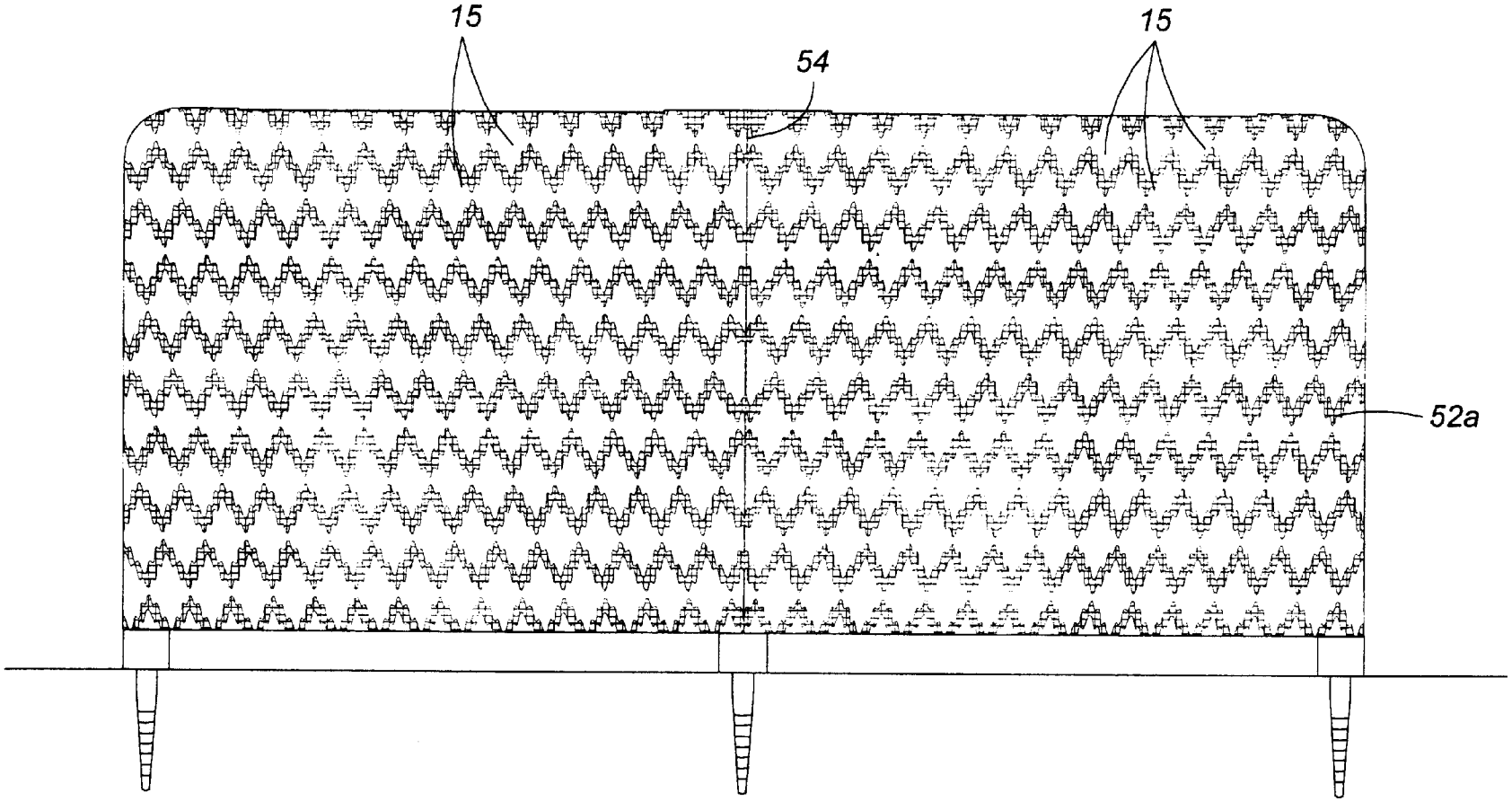
FIG. 3 is a front plan view of the blind of FIG. 1.

FIG. 2 is a rear view of the blind 10 and FIG. 3 is a frontal view. As can be seen and will be described more fully below, the sheet material 12 is preferably attached to the support system 14 such that the support system 14 is not visible when viewed from the front of the blind 10 and is substantially concealed by the sheet material 12 even when viewed from the back.

Figure 4:
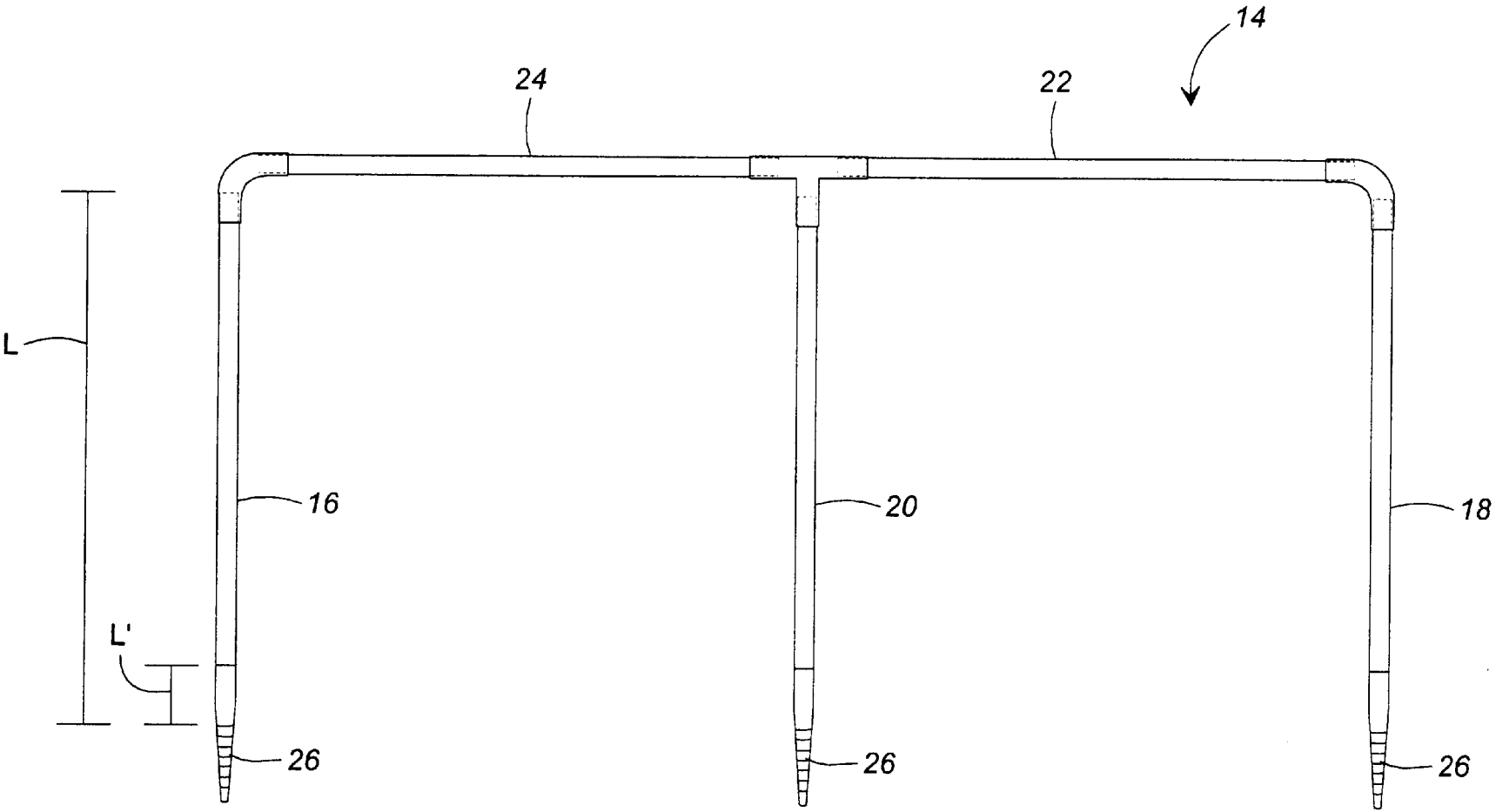
FIG. 4 is a front plan view of a support system for use in the blind of FIG. 1.
Figure 5:
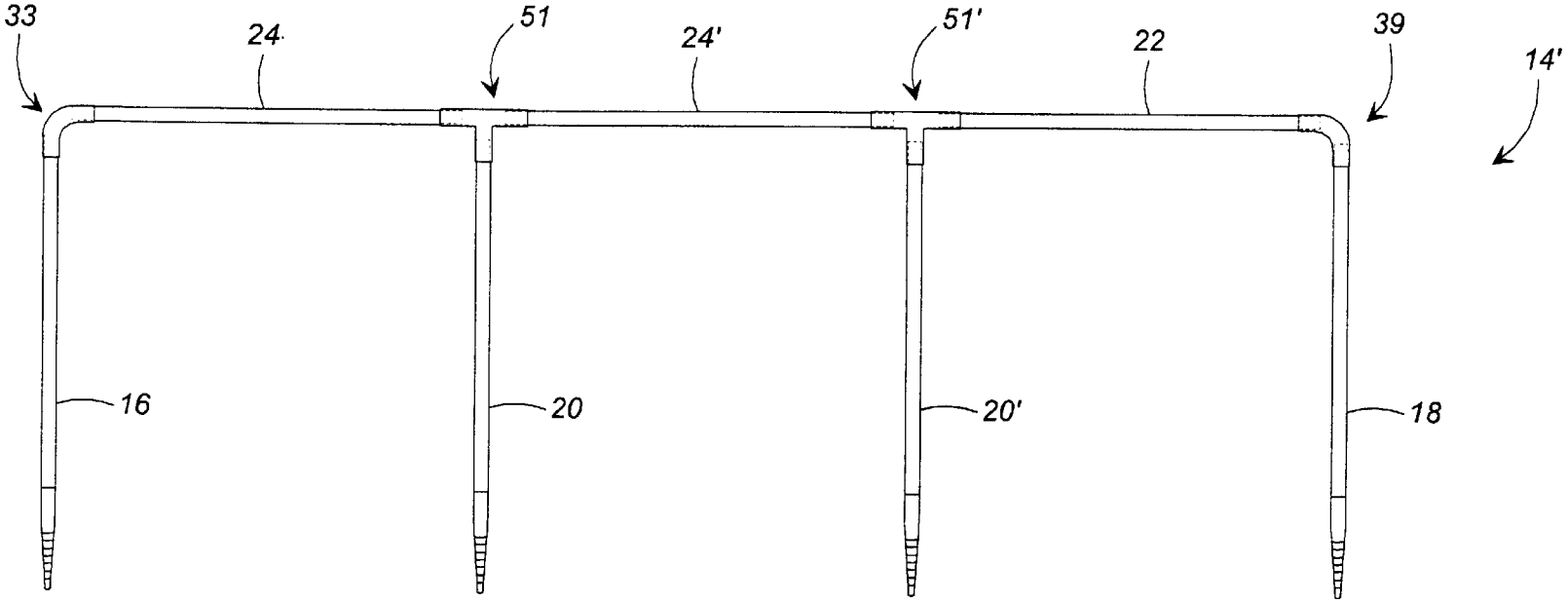
FIG. 5 is a front plan view of an alternate embodiment of a support system according to the invention.

With reference to FIG. 4, the support system 14 preferably includes outer vertical support members 16 and 18 and inner vertical support member 20 located between the members 16 and 18. A horizontal support member 22 is positioned to extend between the upper end of vertical support member 18 and the upper end of vertical support member 20, and horizontal support member 24 is positioned to extend between the upper end of vertical support member 16 and the upper end of vertical support member 20. FIG. 5 shows an alternate embodiment of a support system 14' which is identical to support system 14 except that it includes an additional vertical support member 20' and horizontal support member 24'. The members 20' and 24' are preferably identical to members 20 and 24, respectively.

Referring again to FIG. 4, each vertical support member 16, 18 and 20 is preferably provided by a hollow aluminum tube having a length L of from about 20 to about 60 inches in length. A preferred aluminum tubing has an outer diameter of from about ⅛ to about ½ inch, most preferably about ¼ inch. For a blind primarily for turkey hunting, the length L is preferably from about 20 to about 30 inches. For a blind primarily for waterfowl or dove hunting, the length L is preferably from about 48 to about 60 inches. Each horizontal support member 22 and 24 is preferably provided by a wooden dowel having an outer diameter of from about ⅛ to about ½ inch, most preferably about ¼ inch, and a length of from about 24 to about 36 inches, most preferably about 30 inches. The wooden dowels are preferably stained or painted a dark camouflage color such as dark brown, green or black or combinations thereof. The total weight of a blind configured for turkey hunting is about 1 pound and the total weight of a blind configured for waterfowl or dove hunting is about 1 and ¼ pounds.

A metal spike 26 having a length of about 7 inches is preferably received in the lower open end of each tube and the lowermost length L' of the tubing, preferably from about 2 to about 3 inches, is preferably mechanically crimped to secure the spike 26 securely in place so that from about 4 to about 5 inches of the spike is exposed for being impaled into the ground for erection of the blind.

Figure 6:
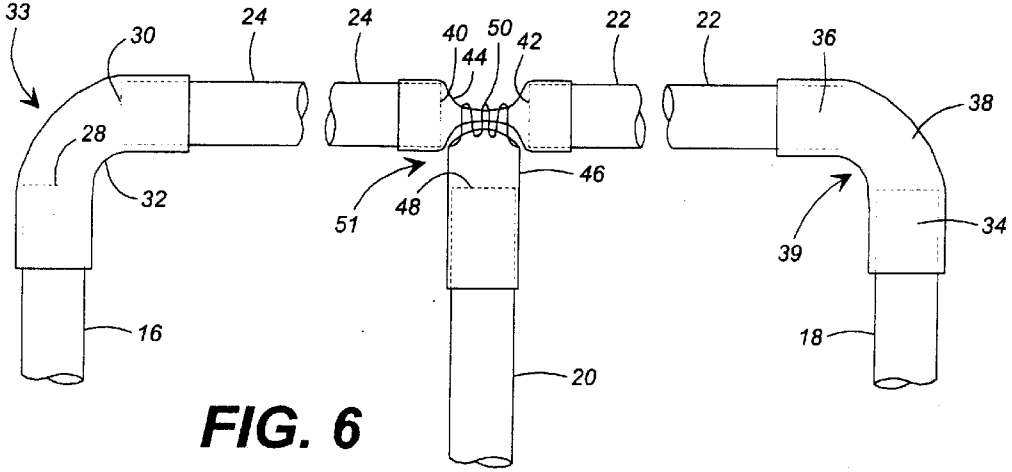
FIG. 6 is an enlarged view of a portion of the support system of FIG. 4.

Turning to FIG. 6, the opposite ends of the horizontal members 22 and 24 are preferably connected to the vertical members 16, 18 and 20 in a manner which permits substantial flexible relative movement of the members. In this regard, upper end 28 of vertical member 16 is preferably connected to end 30 of the horizontal member 24 by a length of flexible polymer tubing 32 having a length of from about 2 to about 5 inches most preferably about three inches and sized to securely receive the ends 28 and 30, to provide a joint 33 which enables relative movement between the joined members. Likewise, upper end 34 of vertical member 18 is preferably connected to end 36 of the horizontal member 22 by a length of flexible polymer tubing 38 of like construction to provide a joint 39 which enables relative movement between the joined members. A preferred polymer tubing is a clear neoprene tubing which remains substantially flexible over a wide temperature range.

Facing ends 40 and 42 of the horizontal members 24 and 22 are connected by a similar length of tubing 44. A similar length of tubing 46 is secured over upper end 48 of the vertical member 20. The upper portion of the tubing 46 is secured to the mid-section of the tubing 44 by folding over the upper end of the tubing 46 and sewing the upper end of the tubing 46 to the tubing 44 as by sewn seam 50 to provide a joint 51 which enables relative movement between the joined members.

As will be appreciated, the joints 33, 39 and 51 enable the respective support members to be flexibly connected in a manner which facilitates quick and simple set-up, take-down and storage of the blind 10 while providing a blind construction that is relatively sturdy and avoids many of the shortcomings of prior blinds.

As mentioned previously, the sheet material 12 is preferably attached to the support system 14 such that the support system 14 is not visible when viewed from the front. In this regard and referring again to FIGS. 2 and 3, the sheet material 12 preferably includes a pair of major portions 52*a* and 52*b* of fabric joined along vertical seam 54 and rod pockets or casings around the vertical members 16, 18 and 20 and the joints 33, 39 and 51 adjacent the backside of the portions 52*a* and 52*b*. That is, casing 56 receives joint 33 and vertical support member 16, casing 58 receives joint 51 and vertical support member 20, and casing 60 receives joint 39 and vertical support member 18. In a like manner, the support system 14' of FIG. 5 would accommodate a third major portion 52*c* (FIG. 7*c*) which would be joined to its adjacent major portion by a seam such as the seam 54.

In this regard, it will be appreciated that the construction of the blind, and particularly that of the joints 33, 39 and 51 (and 51') enable simplified construction of the blind as compared to prior blinds. For example, the joints enable a foldable construction that requires the use of only one vertical support member between adjacent major portions. That is, where there are n major portions (where n=2 for the support system of FIG. 4 and n=3 for the support system of FIG. 5) the blind requires (n+1) vertical support members (e.g. 3 vertical support members 16, 18 and 20 as shown in FIG. 4 and 4 members 16, 18, 20 and 20' as shown in FIG. 5). The joints also provide a sturdy set-up which maintains the sheet material 12 in a relatively taught manner that avoids the need for additional supports such as guy ropes and stakes. Also, the horizontal cross members are rigidly positioned to serve as gun or camera rests, yet can be positioned so that the entire blind can be rolled into a tight compact package that is convenient to transport and store and thereafter easily repositioned for set-up of the blind.

Figure 7A:
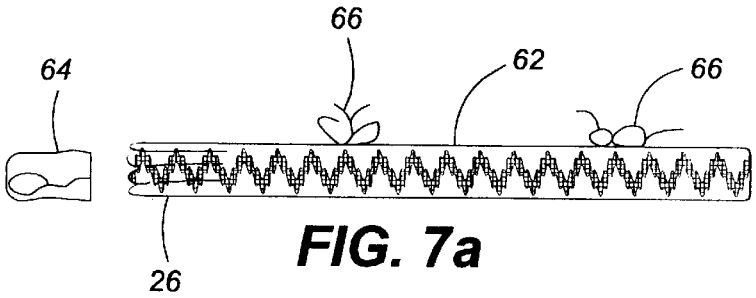
FIGS. 7*a*–7*c* show steps for erecting the blind of FIG. 1.
Figure 7B:
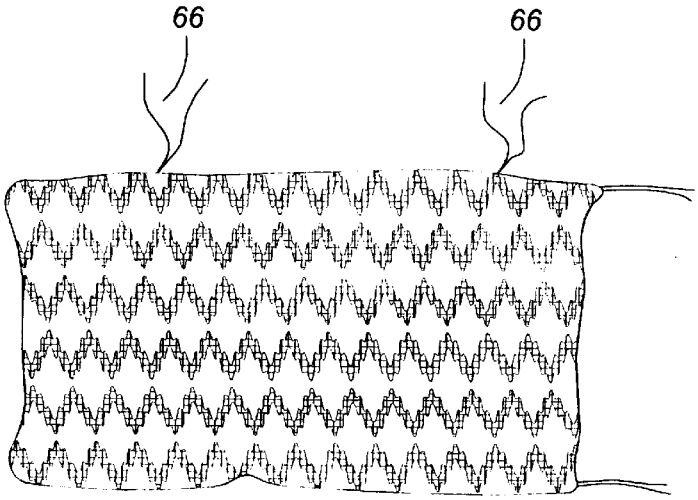
Figure 7C:
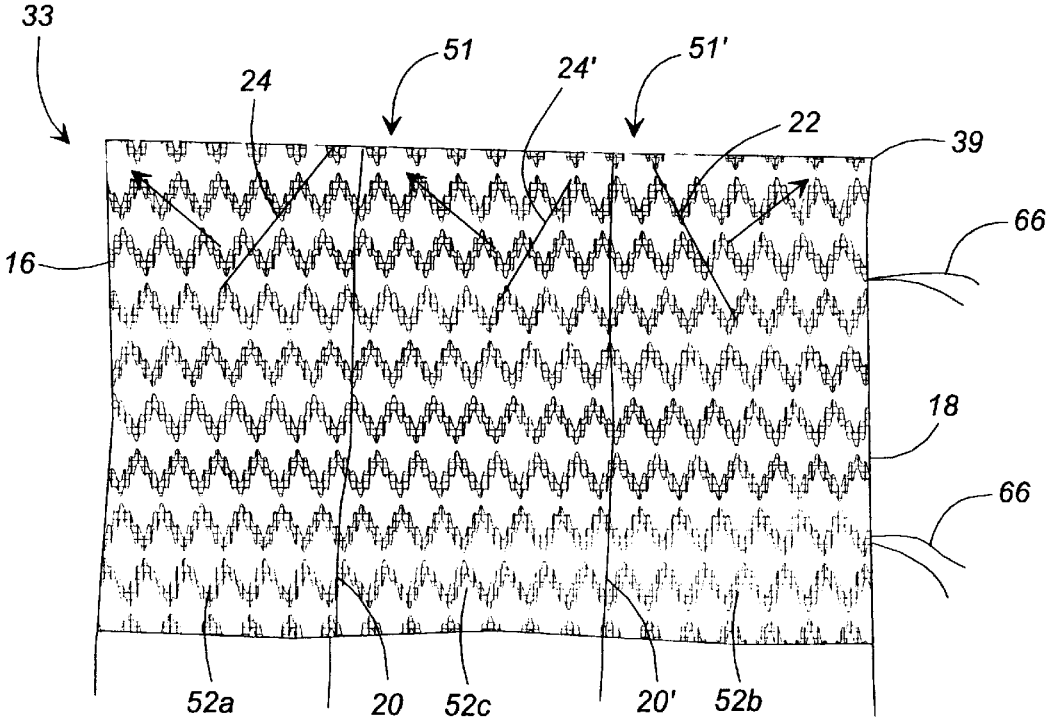

In this regard and with reference to FIGS. 7*a*–7*c*, there is shown a preferred method for erecting the blind. This method is particularly preferred for blinds having vertical support members that are substantially longer than the horizontal support members or having more than two panels. As can be seen in FIG. 7*a*, the blind may be rolled up into a tight and compact bundle 62 wherein the lower ends of the vertical support members are at the same end of the bundle. An optional protective cap, such as a fabric, leather or polymer cap 64 may be placed over the end of the bundle to cover the spikes 26 of the lower ends. Lengths of line or string 66 are preferably attached as by sewing to an edge of the blind for tying the bundle 62.

To erect the blind, strings 66 are untied and the bundle 62 unrolled as shown in FIG. 7*b*. Turning to FIG. 7*c*, it will be noticed that one end of each of the horizontal support members 24, 24' and 22 are pulled loose from one of their associated joints and thus may be pivoted to align with the vertical support members 16, 18,20 and 20'. This facilitates rolling up of the bundle with the spikes 26 at a common end. The blind may be quickly and easily re-assembled by inserting the free ends of the horizontal support members into the tubing of the respective joints and thereafter impaling the spikes into the ground. Disassembly may be quickly accomplished by reversing the sequence of FIGS. 7*a*–7*c*.

Figure 8A:
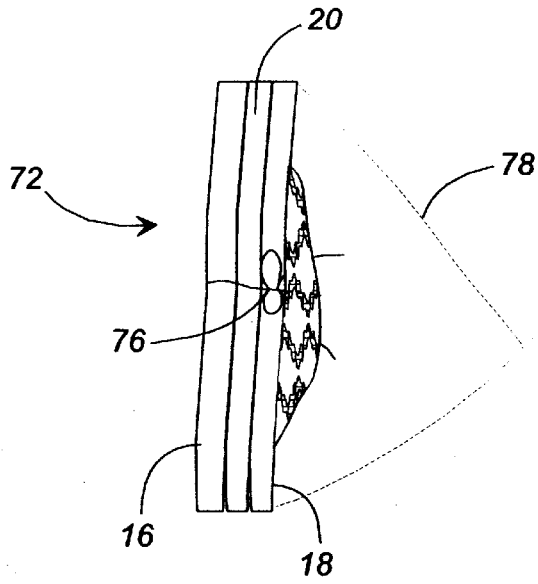
FIGS. 8*a*–8*e* show alternate steps for erecting the blind of FIG. 1.

With reference to FIGS. 8*a*–8*e*, there is shown another preferred method for erecting the blind 10. This method is particularly preferred for blinds having two panels and vertical members that are about the same length as the horizontal support members. As can be seen in FIG. 8*a*, the blind may be rolled up into a tight and compact bundle 72 which is similar to the bundle 62 except that the lower ends of the vertical support members are not at the same end of the bundle. That is, the lower ends of the vertical support members 16 and 18 are aligned, but the lower end of the vertical support member 20 is at the opposite end of the bundle. Lengths of line or string 76 are preferably attached as by sewing to an edge of the blind for tying the bundle 72. This configuration is easier to set-up and take-down than the bundle 62 in that the horizontal support members 22 and 24 remain connected to the joints at all times.

Figure 8B:
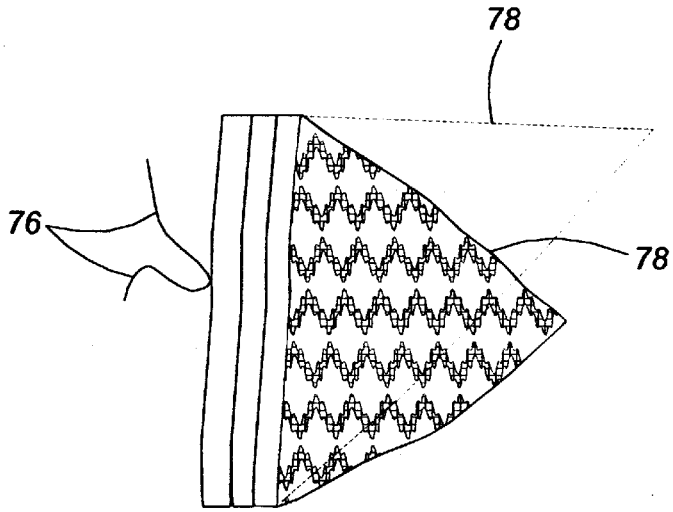
Figure 8C:
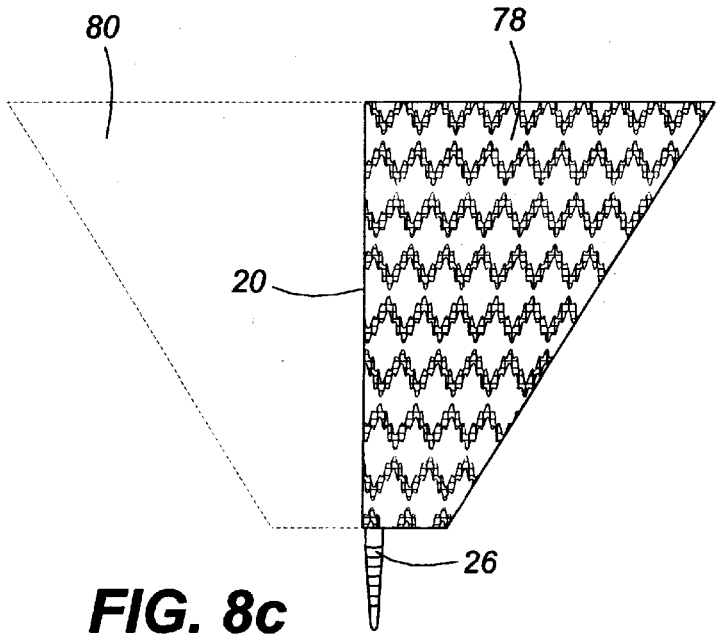
Figure 8D:
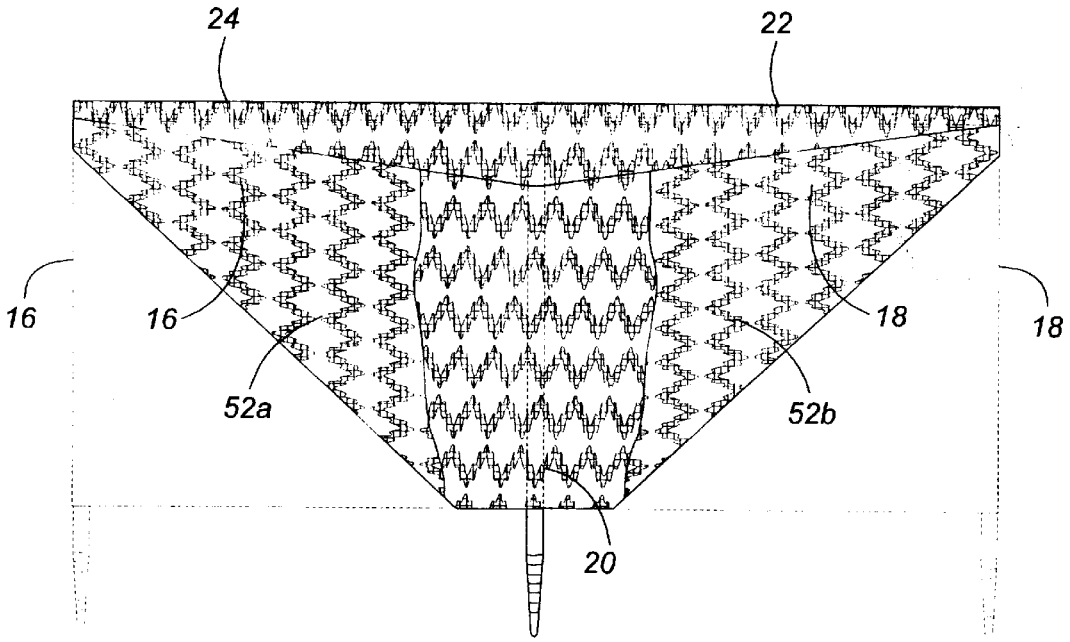
Figure 8E:
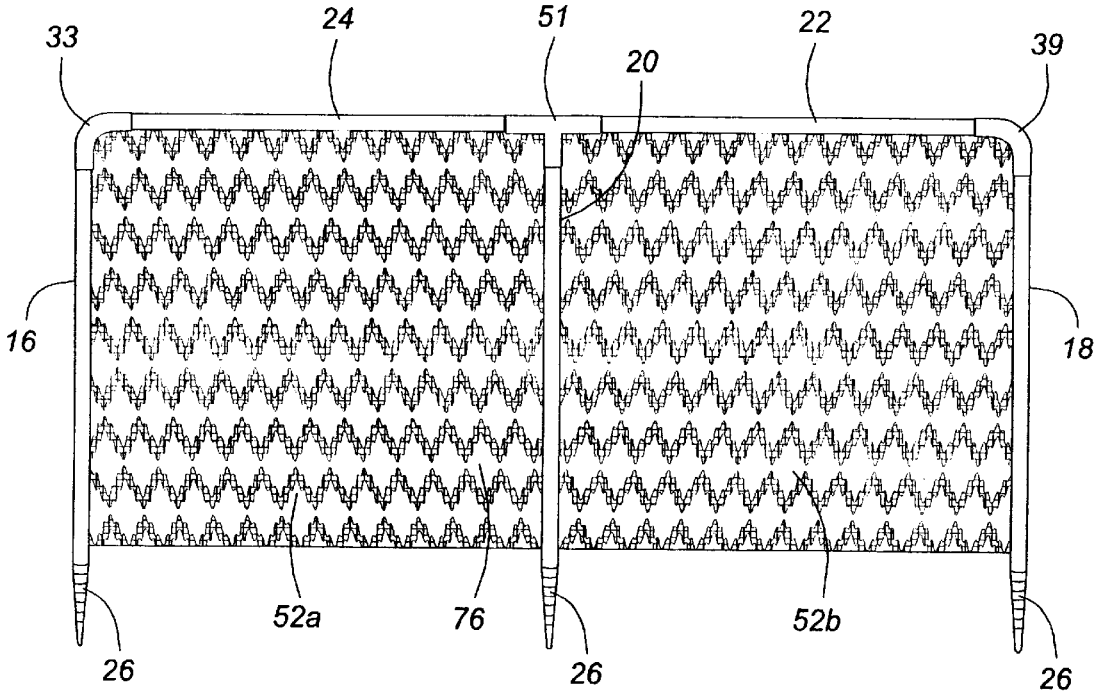

To erect the blind, strings 76 are untied and the bundle 72 unfolded into the configuration as indicated by the dashed line in FIG. 8*a* and as shown in FIG. 8*b*. This step may be accomplished by holding the member 18 and 22 together as a unit (indicated as 78) and pulling them together away from the bundle and then upwardly to the orientation shown in FIG. 8*c*. The identical step may then be repeated for the unit 80 provided by members 16 and 24. Optionally, this may be combined into one step by simultaneously grasping units 78 and 80 with opposite hands and unfolding them to their desired orientations. Next, as shown in FIG. 8*d*, the members 16 and 18 are pivoted or moved downwardly as indicated by the dashed lines of FIG. 8*d* to provide configuration of FIG. 8*e* which may be installed by impaling the spikes 26 into the ground. Disassembly may be quickly accomplished by reversing the sequence of FIGS. 8*a*-8*e*

As will be appreciated, the invention overcomes many of the disadvantages of prior blinds. The blind of the invention is lightweight and cost effective and is readily set-up, taken-down and stored or transported. The blind avoids the need for guy ropes and stakes and the like and is easily set-up and taken down in a matter of seconds. This is extremely significant as it enables the blind to be used in stalking situations. For example, in turkey hunting, an effective method is to walk very quietly and slowly while periodically imitating the sounds of a wild turkey. A turkey will often respond or gobble indicating the location of the turkey to the hunter. Upon hearing the gobble, the hunter can advance toward the turkey and, when reaching a location desirably close to the turkey, quickly and quietly erect the blind and await the bird. This technique is not practical with conventional blinds which are either too bulky to be carried in a convenient and quiet manner or are too cumbersome to set up quickly and quietly because they require guy ropes, stakes and/or other stability aids.

Figure 9:
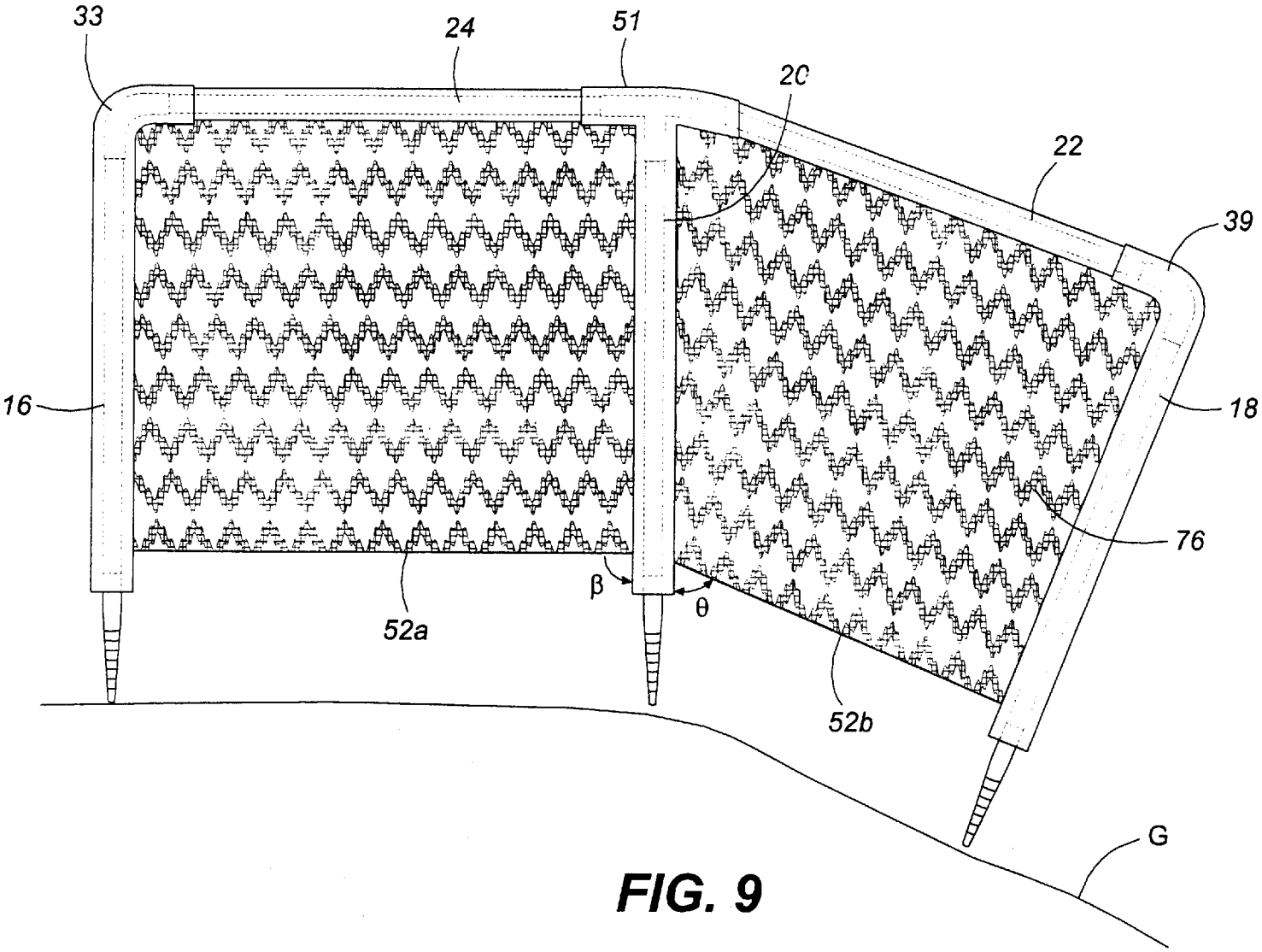
FIG. 9 shows the blind of FIG. 1 assembled and erected on unlevel terrain.

In addition, the blind is readily adapted to various set-up orientations and terrain conditions. For example, as shown in FIG. 1, the joints enable the blind to be erected in various angular orientations. That is, the angular relationship of the sections 52*a* and 52*b* may be varied by changing the angle $\alpha$ to virtually any desired angle. Also, as shown in FIG. 9, the joints further enable the blind to be adapted to irregular topography that prior blinds are not generally suited for. That is, the angles $\beta$ and $\Theta$ may be adjusted to conform to the terrain. As will be noticed, the joints 51 and 39 cooperate to enable the horizontal member 22 to be aligned with the terrain and still provide a stable gun or camera rest, while a slight slackness in the portion 52*b* accommodates the terrain without having a detrimental effect on the blind.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A blind, comprising:

a support system and a sheet material secured to at least a portion of the support system, the support system comprising a number (n) of horizontal support members and a number (n+1) of vertical support members, wherein n corresponds to an integer of 2 or greater, and a plurality of flexible joints, each flexible joint connecting a vertical support member to at least one horizontal support member, at least one of the vertical support members being connected by one of the joints to at least two horizontal support members, wherein at least one of the joints connecting one of the horizontal support members to one of the vertical support members comprises a length of polymer tubing having one end fittingly received on an end of the one of the horizontal support members and an opposite end fittingly received over an end of the one of the vertical support members.

2. The blind claim 1, wherein the horizontal support members are substantially rigid.

3. The blind of claim 1, wherein the vertical support members are substantially rigid and each have lower ends configured for being impaled into the ground.

4. The blind of claim 1, wherein the lower ends of at least one of the vertical support members include spikes configured for being impaled into the ground.

5. The blind of claim 1, wherein the sheet material includes a plurality of casings, with each of the casings substantially surrounding one of the vertical support members.

6. A blind, comprising:

a support system and a sheet material secured to at least a portion of the support system, the support system comprising a number (n) of horizontal support members and a number (n+1) of vertical support members, wherein n corresponds to an integer of 2 or greater, and a plurality of flexible joints, each flexible joint connecting a vertical support member to at least one horizontal support member, at least one of the vertical support members being connected by one of the joints to at least two horizontal support members, wherein the joint connecting one of the vertical support members to at least two horizontal support members comprises a first length of polymer tubing having its opposite ends fittingly received over adjacent ends of two of the horizontal support members and a second length of polymer tubing having one of its ends fittingly received over an end of one of the vertical support members and the opposite end of the second length of polymer tubing fixedly secured to a portion of the first length of polymer tubing.

7. The blind of claim 6, wherein the second length of polymer tubing is fixedly secured to the first length of polymer tubing by threads.

8. A blind, comprising:

a support system and a sheet material secured to at least a portion of the support system, the support system comprising a number (n) of horizontal support members and a number (n+1) of vertical support members, wherein n corresponds to an integer of 2 or greater, and a plurality of flexible joints, each flexible joint connecting a vertical support member to at least one horizontal support member, at least one of the vertical support members being connected by one of the joints to at least two horizontal support members, wherein the sheet material includes a plurality of casings, with each of the casings substantially surrounding one of the vertical support members and one of the joints for attaching the sheet material to at least a portion of the support system.

9. A support system for a blind, comprising:

a number (n) of horizontal support members and a number (n+1) of vertical support members, wherein n corresponds to an integer of 2 or greater, and a plurality of flexible joints, each flexible joint connecting vertical support member to at least one horizontal support member, at least one of the vertical support members being connected by one of the joints to at least two horizontal support members, wherein at least one of the joints connecting one of the horizontal support members to one of the vertical support members comprises a length of polymer tubing having one end fittingly received on an end of the one of the horizontal support members and an opposite end fittingly received over an end of the one of the vertical support members.

10. A support system for the blind comprising:

a number (n) of horizontal support members and a number (n+1) of vertical support members, wherein n corresponds to an integer of 2 or greater, and a plurality of flexible joints, each flexible joint connecting vertical support member to at least one horizontal support member, at least one of the vertical support members being connected by one of the joints to at least two horizontal support members, wherein the joint connecting one of the vertical support members to at least two horizontal support members comprises a first length of polymer tubing having its opposite ends fittingly received over adjacent ends of two of the horizontal support members and a second length of polymer tubing having one of its ends fittingly received over an end of one of the vertical support members and the opposite end of the second length of polymer tubing fixedly secured to a portion of the first length of polymer tubing.

11. The blind of claim 10, wherein the second length of polymer tubing is fixedly secured to the first length of polymer tubing by threads.

12. A collapsible and portable blind system, comprising:

a collapsible support system, a sheet material secured to at least a portion of the support system and means for securing the support system and the sheet material in an elongate, rolled configuration for ease of transportation and storage, the support system comprising a plurality of horizontal support members, a plurality of vertical support members, and a plurality of flexible joints, each flexible joint being configured to enable at least one vertical support member to be selectively connectable to at least one horizontal support member, wherein the joints and the horizontal and vertical support members cooperate to enable the support system and the sheet material to be configured in the elongate, rolled configuration, wherein one of the joints connecting one of the horizontal support members to one of the vertical support members comprises a length of polymer tubing having one end fittingly received on an end of the one of the horizontal support members and an opposite end fittingly received over an end of the one of the vertical support members.

* * * * *